US006705543B2

(12) United States Patent
Carroll, III et al.

(10) Patent No.: US 6,705,543 B2
(45) **Date of Patent: *Mar. 16, 2004**

(54) VARIABLE PRESSURE FUEL INJECTION SYSTEM WITH DUAL FLOW RATE INJECTOR

(75) Inventors: John T. Carroll, III, Columbus, IN (US); Donald J. Benson, Columbus, IN (US); Yul J. Tarr, Columbus, IN (US)

(73) Assignee: Cummins Inc., Columbus, IN (US)

( * ) Notice: Subject to any disclaimer, the term of this patent is extended or adjusted under 35 U.S.C. 154(b) by 135 days.

This patent is subject to a terminal disclaimer.

(21) Appl. No.: 09/933,898

(22) Filed: Aug. 22, 2001

(65) Prior Publication Data

US 2003/0038185 A1 Feb. 27, 2003

(51) Int. Cl.[7] ..... F02M 47/02; F02M 41/16; F02M 61/20; B05B 9/00

(52) U.S. Cl. ..... 239/96; 239/88; 239/124; 239/533.3; 239/533.9

(58) Field of Search ..... 239/88, 89, 91, 239/96, 124, 533.2, 533.3, 533.9, 533.4, 127, 585.1, 585.4, 585.5, 5; 251/129.15, 129.21, 127; 123/445, 446, 447, 468, 472

(56) References Cited

U.S. PATENT DOCUMENTS

| | | | |
|---|---|---|---|
| 2,075,949 | A | 4/1937 | Lemon |
| 2,243,011 | A | 5/1941 | L'Orange |
| 2,959,360 | A | 11/1960 | Nichols |
| 3,339,848 | A | 9/1967 | Geiger |
| 4,151,958 | A | 5/1979 | Hofmann |
| 4,168,804 | A | 9/1979 | Hofmann |
| 4,187,825 | A | 2/1980 | Loyd, Jr. |
| 4,200,237 | A | 4/1980 | Urlaub et al. |
| 4,202,500 | A | 5/1980 | Keiczek |
| 4,215,821 | A | 8/1980 | Eblen |
| 4,269,360 | A | 5/1981 | Kopse |
| 4,284,043 | A | 8/1981 | Happel |
| 4,285,471 | A | 8/1981 | Eblen et al. |
| 4,382,554 | A | 5/1983 | Hofmann |
| 4,546,739 | A | 10/1985 | Nakajima et al. |
| 4,658,824 | A | 4/1987 | Scheibe |
| 4,736,712 | A | 4/1988 | Savkar et al. |

(List continued on next page.)

FOREIGN PATENT DOCUMENTS

| | | |
|---|---|---|
| GB | 2 266 559 A | 11/1993 |
| JP | 4-140468 A | 5/1992 |

OTHER PUBLICATIONS

P.L. Herzog et al., "$NO_x$ Reduction Strategies for DI Diesel Engines", SAE Technical paper No. 920470, (1992), pp. 1–17.

D.R. Coldren et al., "Advanced Technology Fuel System for Heavy Duty Diesel Engines", SAE Technical Paper No. 973182, Nov. 17–19, 1997, pp. 1–11.

*Primary Examiner*—Davis Hwu
(74) *Attorney, Agent, or Firm*—Nixon Peabody LLP; Tim L. Brackett, Jr.

(57) ABSTRACT

A variable pressure fuel injection system and multi-flow rate injector is provided which produces multiple fuel injection flow rates from a common source of pressurized fuel to enable reductions in emissions, combustion noise and particulates while improving fuel consumption. The present invention includes inner and outer needle valve elements biased into respective closed positions against respective valve seats for controlling the flow through corresponding sets of injection orifices. The movement of each valve is controlled by an injection control valve controlling the drain flow of control fuel from respective control volumes positioned at outer ends of the valve elements. Valve element bias spring preloads along with control flow orifices and needle valve element surface areas are selected to cause, for example, single valve operation at low fuel supply pressure and dual valve operation at high supply pressure.

16 Claims, 12 Drawing Sheets

U.S. PATENT DOCUMENTS 4,758,169 A 7/1988 Steiger
4,826,080 A 5/1989 Ganser
4,856,713 A 8/1989 Burnett
4,958,605 A 9/1990 O'Neal et al.
4,984,738 A 1/1991 Winquist
5,199,398 A 4/1993 Nylund
5,341,783 A 8/1994 Beck et al.
5,458,292 A 10/1995 Hapeman
5,463,996 A 11/1995 Maley et al.
5,535,723 A 7/1996 Gibson et al.
5,588,412 A 12/1996 Nozaki
5,647,316 A 7/1997 Hellen et al.
5,647,536 A 7/1997 Yen et al.
5,676,114 A 10/1997 Tarr et al.
5,711,277 A 1/1998 Fuseya
5,732,679 A 3/1998 Takahasi et al.
5,765,755 A 6/1998 Peters et al.
5,860,597 A 1/1999 Tarr
5,884,611 A 3/1999 Tarr et al.
5,899,389 A 5/1999 Pataki et al.
6,056,264 A 5/2000 Benson et al.
6,155,503 A 12/2000 Benson et al.
6,557,776 B2 * 5/2003 Carroll, III et al. ..... 239/5
6,557,779 B2 * 5/2003 Perr et al. ..... 239/96

* cited by examiner

INJECTED QUANTITY vs. SUPPLY PRESSURE* and INJECTION DURATION

VARIABLE PRESSURE FUEL INJECTION SYSTEM WITH DUAL FLOW RATE INJECTOR

TECHNICAL FIELD

This invention relates to an improved fuel injection system and fuel injector which effectively controls the flow rate of fuel injected into the combustion chamber of an engine.

BACKGROUND OF THE INVENTION

In most fuel supply systems applicable to internal combustion engines, fuel injectors are used to direct fuel pulses into the engine combustion chamber. A commonly used injector is a closed-needle injector which includes a needle assembly having a spring-biased needle valve element positioned adjacent the needle orifices for resisting blow back of exhaust gas into the pumping or metering chamber of the injector while allowing fuel to be injected into the cylinder. The needle valve element also functions to provide a deliberate, abrupt end to fuel injection thereby preventing a secondary injection which causes unburned hydrocarbons in the exhaust. The needle valve is positioned in a needle cavity and biased by a needle spring to block fuel flow through the needle orifices. In many fuel systems, when the pressure of the fuel within the needle cavity exceeds the biasing force of the needle spring, the needle valve element moves outwardly to allow fuel to pass through the needle orifices, thus marking the beginning of injection. In another type of system, such as disclosed in U.S. Pat. No. 5,676,114 to Tarr et al., the beginning of injection is controlled by a servo-controlled needle valve element. The assembly includes a control volume positioned adjacent an outer end of the needle valve element, a drain circuit for draining fuel from the control volume to a low pressure drain, and an injection control valve positioned along the drain circuit for controlling the flow of fuel through the drain circuit so as to cause the movement of the needle valve element between open and closed positions. Opening of the injection control valve causes a reduction in the fuel pressure in the control volume resulting in a pressure differential which forces the needle valve open, and closing of the injection control valve causes an increase in the control volume pressure and closing of the needle valve. U.S. Pat. No. 5,463,996 issued to Maley et al. discloses a similar servo-controlled needle valve injector.

Internal combustion engine designers have increasingly come to realize that substantially improved fuel supply systems are required in order to meet the ever increasing governmental and regulatory requirements of emissions abatement and increased fuel economy. It is well known that the level of emissions generated by the diesel fuel combustion process can be reduced by decreasing the volume of fuel injected during the initial stage of an injection event while permitting a subsequent unrestricted injection flow rate. As a result, many proposals have been made to provide injection rate control devices in closed needle fuel injector systems. One method of controlling the initial rate of fuel injection is to spill a portion of the fuel to be injected during the injection event. For example, U.S. Pat. No. 5,647,536 to Yen et al. discloses a closed needle injector which includes a spill circuit formed in the needle valve element for spilling injection fuel during the initial portion of an injection event to decrease the quantity of fuel injected during this initial period thus controlling the rate of fuel injection. A subsequent unrestricted injection flow rate is achieved when the needle valve moves into a position blocking the spill flow causing a dramatic increase in the fuel pressure in the needle cavity. However, the needle valve is not servo-controlled and, thus, this needle assembly does not include a control volume for controlling the opening and closing of the needle valve and the timing of injection at least primarily fuel pressure dependent.

Another manner of optimizing combustion is to create pilot and/or post injection events. Most current diesel injectors include fixed needle orifice areas sized to provide optimum injection duration at rated speed and load with the highest allowable injection pressure. However, in order to optimize combustion, pilot and post injection events must include extremely small quantities of fuel at high injection pressures. With a fixed spray orifice size, this results in an extremely short event that is difficult to control. To compensate, the needle opening velocity may be reduced so that the fuel flow is throttled before the spray orifices during the pilot and post injection events. However, needle velocity is not easily controllable from injector to injector, while throttling wastes fuel energy and does not provide optimum combustion performance. At low speed and light load, it is also desirable to have small spray orifices to increase injection duration without lowering injection pressure.

Another fuel injector design providing some limited control over fuel injection rate and quantity includes two needle valve elements for controlling the flow of fuel through respective sets of injection orifices. For example, U.S. Pat. No. 5,458,292 to Hapeman discloses a fuel injector with inner and outer injector needle valves biased to close respective sets of spray holes and operable to open at different fuel pressures. The inner needle valve is reciprocally mounted in a central bore formed in the outer needle valve. However, the opening of each needle valve is controlled solely by injection fuel pressure acting on the needle valve in the opening direction such that the valves necessarily open when the injection fuel pressure reaches a predetermined level. Consequently, the overall and relative timing of opening of the valves, and the rate of opening of the valves, cannot be controlled independently. Moreover, the valve opening timing and rate is dependent on the injection fuel pressure.

U.K. Patent Application No. 2266559 to Hlousek discloses a closed needle injector assembly including a hollow needle valve for cooperating with one valve seat formed on an injector body to provide a main injection through all the injector orifices and an inner valve needle reciprocally mounted in the hollow needle for creating a pre-injection through a few of the injector orifices. However, the valve seat allowing the inner valve needle to block the pre-injection flow is formed on the hollow valve member and the inner valve needle is biased outwardly away from the injector orifices. This arrangement requires a third valve seat for cooperation with the inner valve element when in a pre-injection open position to prevent flow through all of the injector orifices, resulting in an unnecessarily complex and expensive assembly. Also, this assembly is designed for use with two different sources of fuel requiring additional delivery passages in the injector. In addition, like Hapeman, this design requires the timing and rate of opening of at least one of the needle valves to be controlled by fuel injection pressure thereby limiting injection control.

U.S. Pat. No. 5,199,398 to Nylund discloses a fuel injection valve arrangement for injecting two different types of fuels into an engine which includes inner and outer poppet type needle valves. During each injection event, the inner needle valve opens a first set of orifices to provide a preinjection and the outer needle valve opens a second set of orifices to provide a subsequent main injection. The outer poppet valve is a cylindrical sleeve positioned around a stationary valve housing containing the inner poppet valve.

U.S. Pat. No. 5,899,389 to Pataki et al. discloses a fuel injector assembly including two biased valve elements controlling respective orifices for sequential operation during an injection event. A single control volume may be provided at the outer ends of the elements for receiving biasing fluid to create biasing forces on the elements for opposing the fuel pressure opening forces. However, the control volume functions in the same manner as biasing springs to place continuous biasing forces on the valve elements. As a result, the needle valve elements only lift when the supply fuel pressure in the needle cavity is increased in preparation of a fuel injection event to create pressure forces greater than the closing forces imparted by the control volume pressure.

U.S. Pat. Nos. 4,202,500 to Keiczek and 4,215,821 to Eblen both disclose injectors having two sets of injector orifices controlled by respective needle valves.

Although some systems discussed hereinabove create different stages of injection, further improvement is desirable. Therefore, there is need for a servo-controlled fuel injector for providing enhanced control over injection timing and flow rate, especially in variable supply pressure systems.

SUMMARY OF THE INVENTION

It is an object of the present invention, therefore, to overcome the disadvantages of the prior art and to provide a fuel injector which is capable of effectively and predictably controlling the rate of fuel injection.

It is another object of the present invention to provide a servo-controlled injector capable of effectively providing a dual injection so as to minimize emissions.

It is another object of the present invention to provide a fuel injection system capable of providing a variable supply pressure and selectively providing either a low fuel injection rate followed by a high fuel injection rate or only a single low fuel injection rate.

It is yet another object of the present invention to provide a fuel injection system capable of selectively producing a wide variety of injection flow rates or rate shapes depending on engine operating conditions while remaining compatible with existing fuel systems.

It is a further object of the present invention to provide an injector for use in a variety of variable pressure fuel systems, including common rail system and accumulator pump systems, which effectively controls the rate of injection at each cylinder location.

Still another object of the present invention is to provide an injector which is capable of selectively creating different injection rate shapes to optimize emissions and fuel economy.

Yet another object of the present invention is to provide an injector which is compatible with existing pilot activated fuel injection mechanisms and methodologies.

Another object of the present invention is to provide an injector which permits injection duration to be extended and fueling accuracy improved at part load conditions.

These and other objects of the present invention are achieved by providing a fuel injection system for injecting fuel into the combustion chamber of an engine comprising a variable pressure fuel supply for supplying fuel at various pressure levels and a fuel injector including an injector body containing an injector cavity and a plurality of injector orifices communicating with one end of the injector cavity to discharge fuel into the combustion chamber. The fuel injector also includes a plurality of injector orifices including a first set of orifices and a second set of orifices. The injector body also includes a fuel transfer circuit for supplying fuel to the injector orifices and a first needle valve element positioned in the injector cavity for controlling fuel flow through the first set of orifices. A first valve seat is formed on the injector body and the first needle valve element is movable from a closed position against the first valve seat blocking flow through the first set of injector orifices to an open position permitting flow through the first set of injector orifices. The fuel injector further includes a second needle valve element positioned in the injector cavity for controlling fuel flow through the second set of injector orifices. The fuel injector also includes a second valve seat formed on the injector body wherein the second valve element is movable from a closed position against the second valve seat blocking flow through the second set of injector orifices to an open position permitting flow through the second set of injector orifices. The fuel injector further includes a first control volume positioned adjacent an upper end of the first needle valve element for receiving fuel and a second control volume positioned adjacent an upper end of the second needle valve element for receiving fuel. The fuel injector also includes a drain circuit for draining fuel from the first and the second control volumes to a low pressure drain. The injector also includes an injection control valve positioned along the drain circuit for controlling the flow of fuel from the first and the second control volumes through the drain circuit to permit movement of the first and the second needle valve elements between the open and the closed positions. The first needle valve element may be telescopingly received within a cavity formed in the second needle valve element to form a sliding fit with an inner surface of the second needle valve element. A throttle passage may be provided in the second needle valve element to restrict fuel flow upstream of the first set of injector orifices during a fuel injection event. A first biasing spring may be provided for biasing the first needle valve element toward the closed position and a second biasing spring for biasing the second needle valve element toward the closed position. The first biasing spring may be positioned within the cavity of the second needle valve element. The first and the second biasing springs may be positioned in overlapping relationship. The injector may also include a separator positioned between the first and the second control volumes and biased into a position by the first biasing spring. The injector may also include a first control volume charge circuit including a charge groove formed in an inner surface of the separator.

The present invention is also directed to the above described fuel injection system wherein the first or inner needle valve element is adapted to open at a predetermined low pressure level while the second needle valve element remains in the closed position. In addition, the second or outer needle valve element is adapted to move into an open position at a higher fuel supply pressure greater than the predetermined low pressure level. The present invention is also directed to a fuel injection system and fuel injector wherein the outer needle valve element is adapted to open at a low pressure level while the inner needle valve element remains in the closed position until a higher predetermined supply pressure level is supplied.

DETAILED DESCRIPTION OF THE PREFERRED EMBODIMENT

Figure 1:
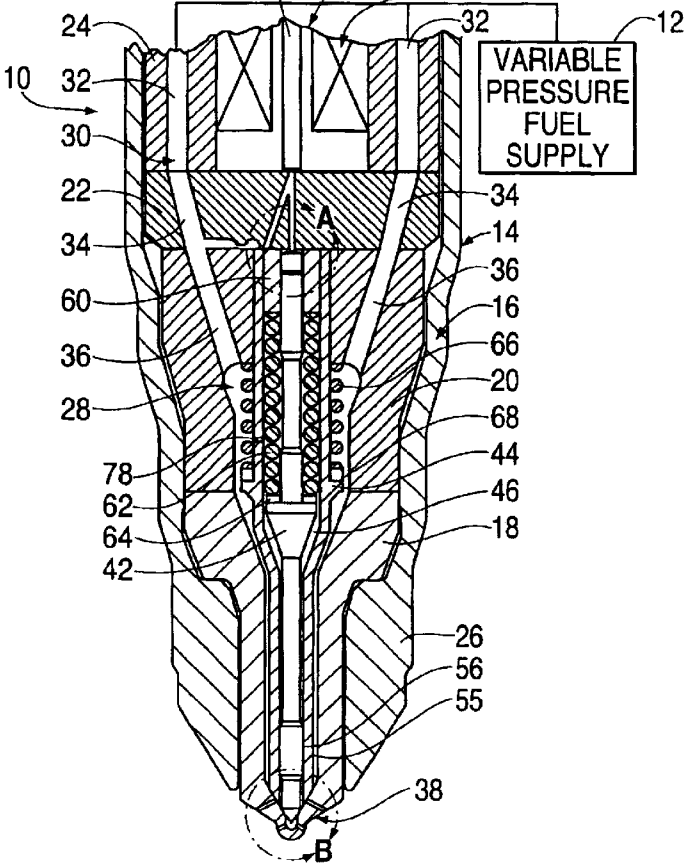
FIG. 1 is an enlarged cross sectional view of the closed nozzle injector of the present invention.
Figure 4:
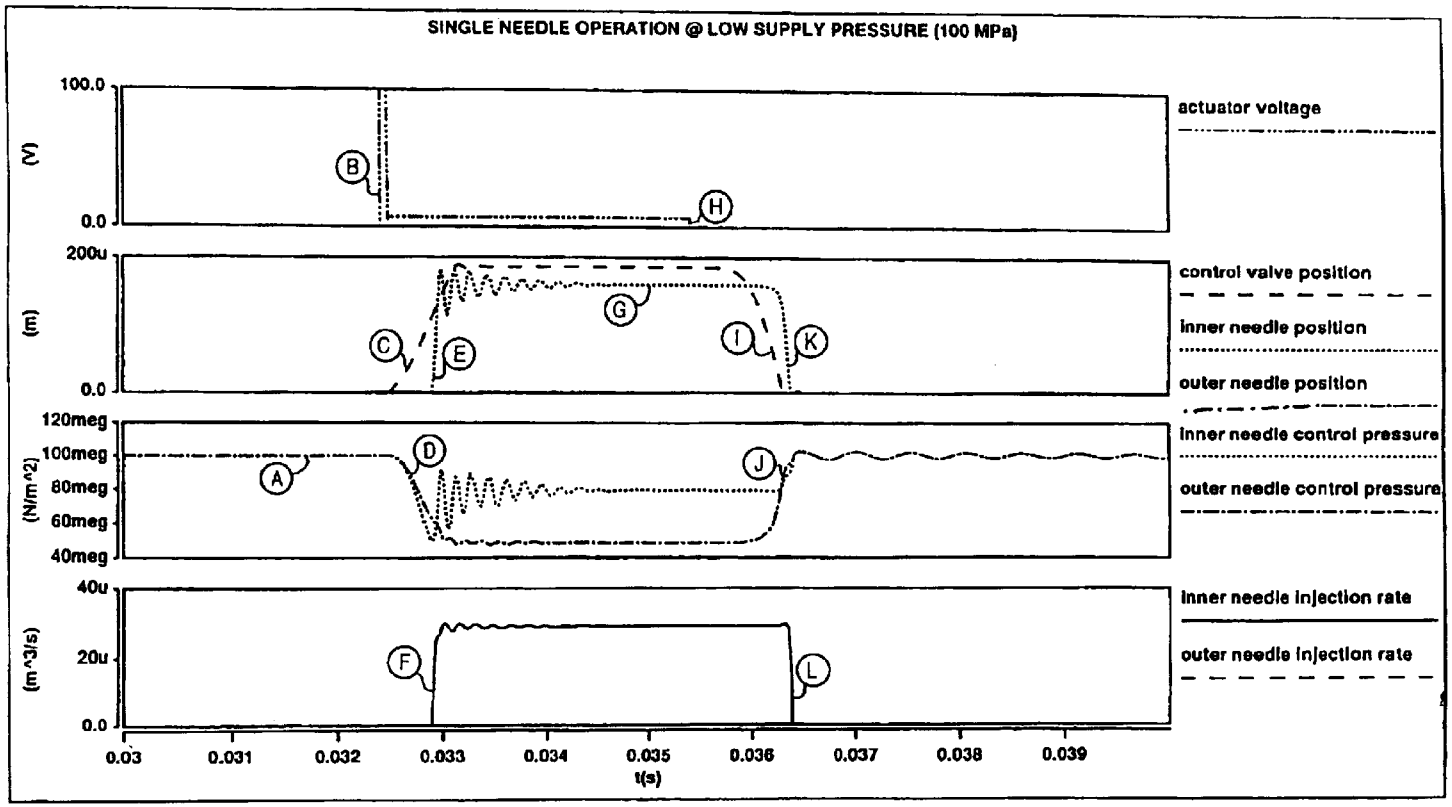
FIG. 4 is a graph showing actuator control voltage, control valve position, inner and outer needle position, inner control volume pressure, outer control volume pressure, inner needle injection rate and outer needle injection rate versus time during an injection event in the single needle operation mode with the injector of the present invention.

Referring to FIG. 1, there is shown a variable pressure fuel injection system, indicated generally at 10, including a variable pressure fuel supply 12 and a closed needle injector 14, which is capable of effectively producing multiple fuel injection mass flow rates, extending injection duration and improving fueling accuracy at part load conditions, providing a low quantity detached pilot injection at all operating conditions and providing an attached pilot injection at moderate to high pressure operating conditions. Closed needle injector 14 of the first embodiment of the present invention generally includes an injector body 16 formed from a nozzle housing 18, spring housing 20, a spacer 22, actuator housing 24 and retainer 26 for holding the various components in compressive abutting relationship. For example, retainer 26 may contain internal threads for engaging corresponding external threads on an upper barrel (not shown) to permit the entire injector body 16 to be held together by simple relative rotation of retainer 26 relative to the upper barrel. Injector body 16 includes an injector cavity, indicated generally at 28. Injector body 16 further includes a fuel transfer circuit 30 comprised, in part, of delivery passages 32 formed in actuator housing 24, transfer passages 34 formed in spacer 22 and delivery passages 36 formed in spring housing 20 for delivering fuel from a high pressure source to injector cavity 28. Injector body 16 also includes a plurality of injector orifices 38 fluidically connecting injector cavity 28, including a mini-sac 40, with a combustion chamber of an engine (not shown). Injector 14 is positioned in a receiving bore (not shown) formed in, for example, the cylinder head of an internal combustion engine. Although variable pressure fuel injection system 10 is illustrated as including only one injector, system 10 may be used on an engine having any number of fuel injectors, for example, an injector for each engine cylinder such as a four, six, eight, ten or twelve cylinder engine.

Variable pressure fuel supply 12 may be any fuel supply capable of supplying fuel at different pressure levels, for example, capable of varying the pressure between a low pressure level and a high pressure level including supplying fuel at any pressure between the low and high pressure levels, such as at a moderate supply pressure level. For example, variable pressure fuel supply 12 may be provided by the fuel system disclosed in U.S. Pat. No. 5,676,114 entitled *Needle Controlled Fuel System with Cyclic Pressure Generation*, the entire contents of which is hereby incorporated by reference. Variable pressure fuel supply 12 may alternatively be in the form of any high pressure common rail or alternatively, a dedicated pump assembly, such as in a pump-line-nozzle system or a unit injector system incorporating, for example, a mechanically actuated plunger into the injector body so long as the system is capable of the variable pressure supply described above.

Closed needle fuel injector 14 also includes a first or inner needle valve element 42 and a second or outer needle valve element 44 both positioned for reciprocal movement within injector cavity 28. Specifically, outer needle valve element 44 has a generally cylindrical shape forming an inner cavity 46 for receiving inner needle valve element 42. Injector orifices 38 include an outer set of orifices 48 and an inner set of orifices 50. An outer valve seat 52 is formed at the lower end of nozzle housing 18 for abutment by the lower end of outer needle valve element 44 when in a closed position so as to prevent fuel flow from injector cavity 28 through outer set of injector orifices 48. An inner valve seat 54 is formed on the inner surface of the lower end of nozzle housing 18 for abutment by the lower end of inner needle valve element 42 when in a closed position to prevent fuel flow from injector cavity 28 through the inner set of injector orifices 50 via mini-sac 40. A lower guiding surface 56 formed on inner needle valve element 42 is sized to form a close sliding fit with the inner surface of outer needle valve element 44 to provide a guiding function while permitting unhindered reciprocal movement of the needle valve elements. Likewise, an upper guiding surface 58 is formed on inner needle valve element 42 and sized to form a close sliding fit with the inner surface of a floating needle separator 60 positioned within the upper end of outer needle valve element 44 so as to create a very restrictive fluid passage. Likewise, the outer surface of floating needle separator 60 is sized to form a close sliding fit with the inner surface of outer needle valve element 44 while also creating a very restrictive fluid passage.

Closed needle injector assembly 14 also includes a first or inner needle biasing spring 62, i.e. coil spring, positioned within inner cavity 46 of outer needle valve element 44 for biasing inner needle valve element 42 into the closed position as shown in FIG. 1. The lower end of inner biasing spring 62 engages an inner needle shim or seat 64 positioned in abutment against a land formed on inner needle valve element 42. The upper end of inner needle biasing spring 62 is seated against the lower end of floating needle separator 60. Closed needle injector assembly 14 also includes a second or outer needle biasing spring 66, i.e. coil spring, positioned in injector cavity 28 around the outer surface of outer needle valve element 44. Thus, outer needle biasing spring 66 surrounds inner needle biasing spring 62 and is positioned in overlapping relationship with inner needle biasing spring 62 along the longitudinal axis of the injector. The inner end of outer needle biasing spring 66 engages a shim or seat 68 positioned in abutment against an annular land formed on outer needle valve element 44. The upper end of outer needle biasing spring 66 engages spring housing 20.

Figure 2:
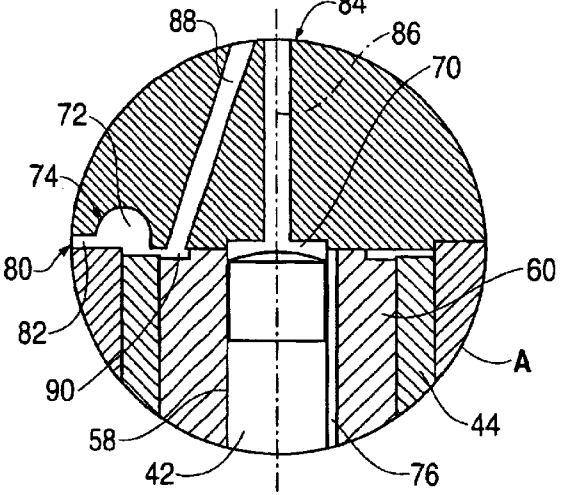
FIG. 2 is an expanded view of the area A of FIG. 1.

Referring to FIG. 2, closed needle injector assembly 14 also includes a first or inner control volume 70 formed within floating needle separator 60 adjacent the upper end of inner needle valve element 42 and a second or outer control volume 72 positioned outside separator 60 adjacent the upper end of outer needle valve element 44. A control volume charge circuit 74 is provided for directing fuel from fuel transfer circuit 30 into inner control volume 70 and outer control volume 72. Specifically, control volume charge circuit 74 includes a first charge passage 76 comprised of a slot formed in the inner surface of floating needle separator 60 for delivering supply fuel from inner cavity 46 to inner control volume 70. It should be noted that supply fuel is delivered from injector cavity 28 to inner cavity 46 via a cross passage 78 formed in outer needle valve element 44. Control volume charge circuit 74 also includes a second charge passage 80 formed in lower spacer 22 for connecting fuel transfer circuit 30 to outer control volume 72. Second charge passage 80 includes an outer inlet control orifice 82. Floating needle separator 60 is maintained in sealing abutment against the lower surface of spacer 22 by inner biasing spring 62.

Closed needle injector assembly 14 also includes a drain circuit, indicated generally at 84, for draining fuel from inner control volume 70 and outer control volume 72 to a lower pressure drain. Specifically, drain circuit 84 includes a first drain passage 86 formed in spacer 22 for draining fuel from inner control volume 70. First drain passage 86 also functions as an inner outlet control orifice. Drain circuit 84 also includes a second or outer control volume drain passage 88 for draining fuel from outer control volume 72 and functioning as an outer outlet control orifice. In the exemplary embodiment shown in FIG. 2, outer control volume drain passage 88 extends through spacer 22 to connect with the upper end of first drain passage 86. The lower end of outer control volume drain passage 88 communicates with an annular groove 90 formed in the upper end of floating needle separator 60 which, in turn, communicates with outer control volume 72.

Closed needle injector assembly 14 of the present embodiment also includes an injection control valve, indicated generally at 92, positioned along drain circuit 84 downstream of the intersection of drain passages 86 and 88 for controlling the flow of fuel through drain circuit 84 so as to permit the controlled movement of inner needle valve element 42 and outer needle valve element 44 as described hereinbelow. Injection control valve 92 includes a control valve member 94 biased into a closed position against a valve seat formed on spacer 22. Injection control valve 92 also includes an actuator assembly 96 capable of selectively moving control valve member 94 between open and closed positions. For example, actuator assembly 96 may be a fast proportional actuator, such as an electromagnetic, magnetostrictive or piezoelectric type actuator. Actuator assembly 98 may be a solenoid actuator such as disclosed in U.S. Pat. No. 6,056,264 or U.S. Pat. No. 6,155,503, the entire contents of both of which are incorporated herein by reference.

Inner needle valve element 42 is of the conventional mini-sac type design whereas outer needle valve element 44 is of the valve covered orifice (VCO) design. Also, the number and size of holes specified for the inner set of spray orifices 50 and the outer set of spray orifices 48 are selected to provide reduced fuel injection rates when the inner needle valve element 42 is operated alone, and conventional fuel injection rates when both inner needle valve element 42 and outer needle valve element 44 are operated as described hereinbelow.

Figure 3:
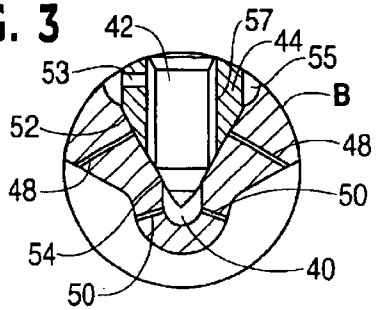
FIG. 3 is an expanded view of the area B of FIG. 1.

As shown in FIG. 3, a feed passage 53 is formed in outer needle valve element 44 to fluidically connect an outer supply cavity 55 to an inner supply cavity 57 formed between inner needle valve element 42 and outer needle valve element 44. Feed passage 53 extends transversely through outer needle valve element 44 and preferably perpendicular to a longitudinal axis of the injector. Feed passage 53 is preferably sized larger than the total cross sectional flow area of the inner set of injector orifices 50 to avoid feed passage 53 functioning to restrict fuel flow while inner needle valve element 42 is in the open position. Alternatively, feed passage 53 may be sized, relative to the total flow area of injector orifices 50, to produce a flow induced pressure drop upstream of inner needle valve element 42 in inner supply cavity 57. This pressure drop and thus the corresponding lower fuel pressure in inner supply cavity 57, reduces the pressure acting on the lower face of inner needle valve element 42 to improve its closing responsiveness. Although the present invention relies on the different biasing spring preloads, needle area ratios and control orifice flow coefficients in combination with variable pressure fuel supply 12 to permit selective control of the needle valve elements 42, 44, feed passage 53 may also be sized to produce a sufficient pressure drop in inner supply cavity 57 adequate to provide further control, such as ensuring outer needle valve element 44 does not lift before inner needle valve element 42 has reached its uppermost open position.

Referring to FIGS. 1–4, during operation, with pressurized supply fuel from variable pressure fuel supply 12 present in fuel transfer circuit 30, outer supply cavity 55 and inner supply cavity 57, and with injection control valve 92 in its normally closed position blocking flow through drain circuit 84, all volumes within injector cavity 28 are pressurized to the supply fuel pressure level. Hydraulic fuel pressure forces are developed on the active surfaces of both needle valve elements 42, 44, i.e. surfaces not excluded by a respective seat area and specifically those valve element areas exposed to the pressurized fuel in inner control volume 70 and outer control volume 72. The hydraulic forces combined with the preloads of inner biasing spring 62 and outer biasing spring 66 to ensure that sufficient needle seating forces are generated to prevent leakage regardless of supply operating pressure. Different modes of operation will now be described based on the level of supply pressure and/or the number of needle valves operating during a given injection event. Importantly, fuel injection system 10 of the present invention permits several different modes of operation to provide a wide variety of rate shape choices to better match the injection rate shape to a particular set of operating conditions thereby permitting reductions in emissions, particulates and combustion noise while also improving brake specific fuel consumption (BSFC). The first mode of operation to be discussed with reference to FIGS. 1–4 is a low pressure, single needle fuel injection mode. Again, with a source of pressurized fuel from variable pressure fuel supply 12 available in fuel transfer circuit 30 and injection control valve 92 in its normally closed position, all volumes within the injector cavity 28 are pressurized to the supply level. This operating state is indicated at A in FIG. 4. From this state, a fuel injection sequence is initiated by energizing actuator assembly 96 (B) to open injection control valve 92 (C). The fuel pressure in both inner control volume 70 and outer control volume 72 drops (D) as fuel flows through the respective unobstructed inner and outer drain passages 86 and 88 respectively, to a low pressure drain. Repressurization of inner control volume 70 and outer control volume 72 is prevented by first charge passage 76 and second charge passage 80 which function as restriction control orifices. The net hydraulic force that held inner needle valve element 42 against its inner valve seat 54 quickly changes direction to oppose the preload of inner needle biasing spring 62 thereby lifting inner needle valve element 42 (E) and allowing fuel to pass from outer supply cavity 55 through feed passage 53, inner supply cavity 57, mini-sac 40 and inner injection orifices 50 (F) into the combustion chamber. Outer needle valve element 44 is prevented from responding in similar fashion, i.e. opening, due to a higher minimum set opening pressure. That is, the fuel supply pressure must be at a higher pressure to affect the opening of outer needle valve element 44 due to the higher preload of outer needle biasing spring 66.

Inner needle valve element 42 hovers (G) in a state of force equilibrium near its upper stop, i.e. the lower surface of spacer 22. Force equilibrium is established and maintained by inner needle valve element 42 as it restricts flow to first drain passage 86. When the equilibrium is disturbed so as to cause inner needle valve element 42 to move toward its upper stop, the flow restriction across the top of inner needle valve element 42 increases, correspondingly increasing the fuel pressure in inner control volume 70 and increasing the resulting hydraulic force imbalance tending to close inner needle valve element 42. Conversely, as the equilibrium is disturbed so as to cause inner needle valve element 42 to move away from its upper stop, the flow restriction into first drain passage 86 decreases, correspondingly decreasing the fuel pressure in inner control volume 70 and decreasing the resulting hydraulic force imbalance tending to close inner needle valve element 42. Inner needle valve element hovering minimizes control flow rate and the associated energy loss required to maintain the injection. The termination of fuel injection is initiated by de-energizing actuator assembly 96 (H). Afterward, injection control valve 92 and thus control valve member 94 closes (I), and fuel flowing through first and second charge passages 76, 80 repressurizes inner and outer control volumes 70, 72 respectively (J). As a result, inner needle valve element 42 closes (K) and the fuel injection event is terminated (L). The previously described hovering action maintains the inner control volume 70 in a pressurized state during the injection process to improve closing responsiveness. Also, as noted hereinabove, feed passage 53 may be sized to function as a feed orifice restricting flow to inner supply cavity 57 to improve low fuel quantity metering performance. Outer needle valve element 44 remains closed during the single needle injection mode to provide a mechanical guide for inner needle valve element 42. Fuel flowing in the vicinity of outer valve seat 52 provides a cooling effect to reduce the tendency for coking and plugging during prolonged periods of single needle operation. Coking and plugging of the outer injection orifices 48 may be avoided altogether during extended single needle operation by flexibly and intermittently operating outer needle valve element 44.

Figure 5:
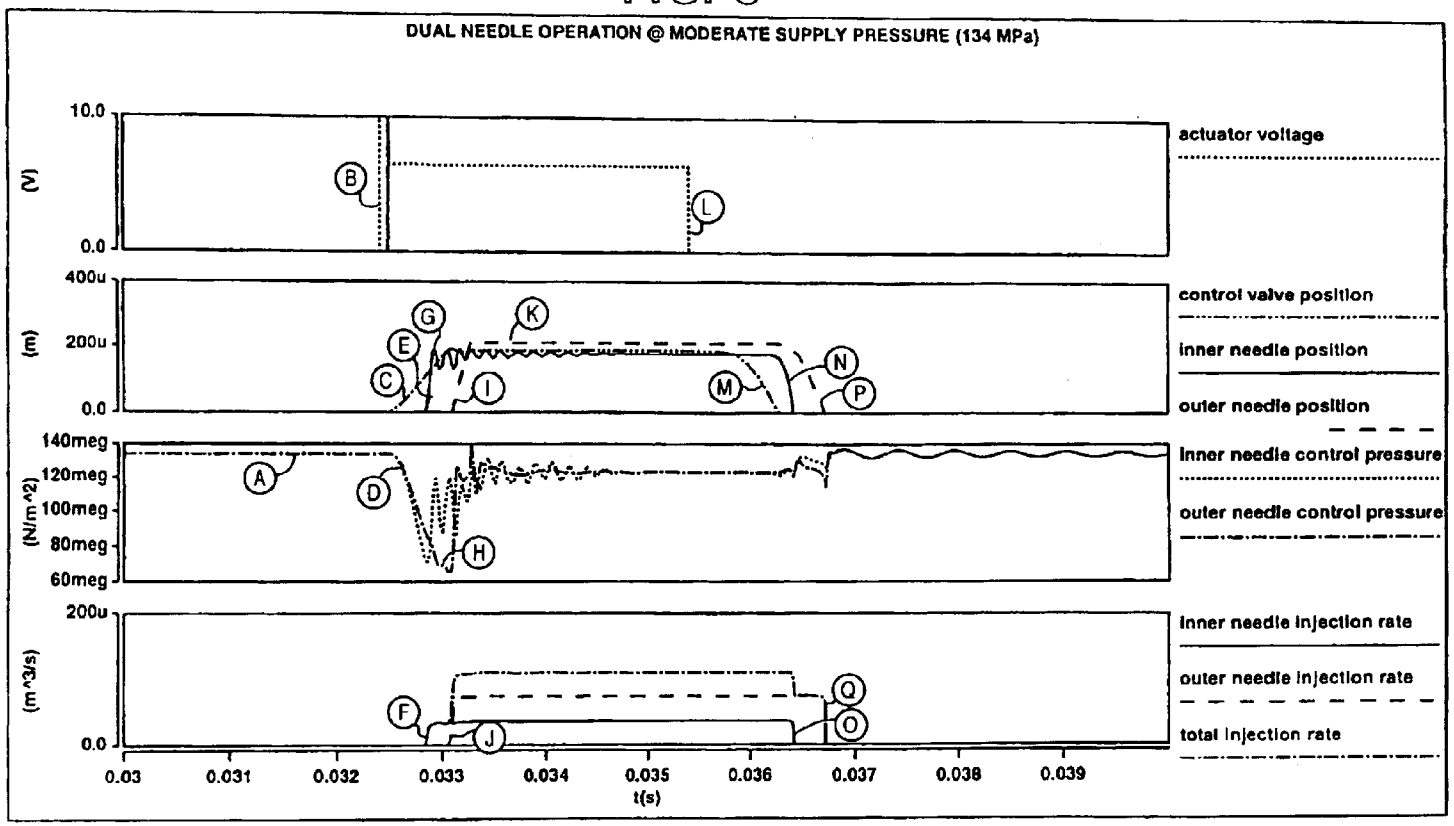
FIG. 5 is a graph showing actuator control voltage, control valve position, inner and outer needle position, inner control volume pressure, outer control volume pressure, inner needle injection rate, outer needle injection rate and total injection rate versus time during an injection event in the dual needle operation mode with the injector of the present invention.

Referring to FIGS. 1–3 and 5, a moderate to high fuel pressure, dual needle fuel injection mode will now be described. At higher operating pressures, for example greater than 100 MPa, both inner needle valve element 42 and outer needle valve element 44 are activated to maximize spray hole utilization and fuel injection rate, and to minimize opportunities for unused spray holes to coke and plug. The injection sequence is initiated by opening injection control valve 92. Inner needle valve element 42 responds first due to the lower preload of inner biasing spring 62, followed by the movement of outer needle valve element 44 after a brief pressure dependent time delay. Both inner and outer needle valve elements 40, 42 hover near the maximum extent of their respective strokes. The hovering actions maintain much of the inner control volume 70 and outer control volume 72 in pressurized states to improve closing responsiveness and minimize controlled flow rates. As shown in FIG. 5, injector cavity 28 is pressurized (A) and actuator assembly 96 energized (B) to cause injection control valve 92 and thus control valve member 94 to open (C) causing the fuel pressure in inner control volume 70 and outer control volume 72 to decrease (D) at different rates. Consequently, inner needle valve element 42 lifts (E) and inner needle injection begins (F). The rate of pressure decay in outer control volume 72 and drain circuit 84 is reduced during the opening motion of the inner needle valve element 42 as a result of the pumping action of the moving inner needle valve. Inner needle valve element 42 then hovers near its stop (G). The fuel pressure in outer control volume 72 continues to decrease (H) causing outer needle valve element 44 to lift (I) causing an outer needle injection to begin (J). Outer needle valve element 44 then hovers near its upper stop (K). To terminate injection, actuator assembly 96 is de-energized (L), causing injection control valve 92 and thus control valve member 94 to move into the closed position (M) causing inner needle valve element 42 to also move into a closed position (N). As a result, the inner needle injection ends (O) and then the outer needle valve element 44 closes (P) ending the outer needle injection event (Q).

Another mode of operation is to provide a single needle operating event at moderate to high pressure. Single needle operation can be achieved at moderate to high supply pressures provided that the commanded injection duration is short enough to prevent activation of outer needle valve element 44. This operating mode may be desirable during transient engine conditions when it may not be possible, practical or efficient to vary the fuel supply pressure using variable pressure fuel supply 12.

Figure 6:
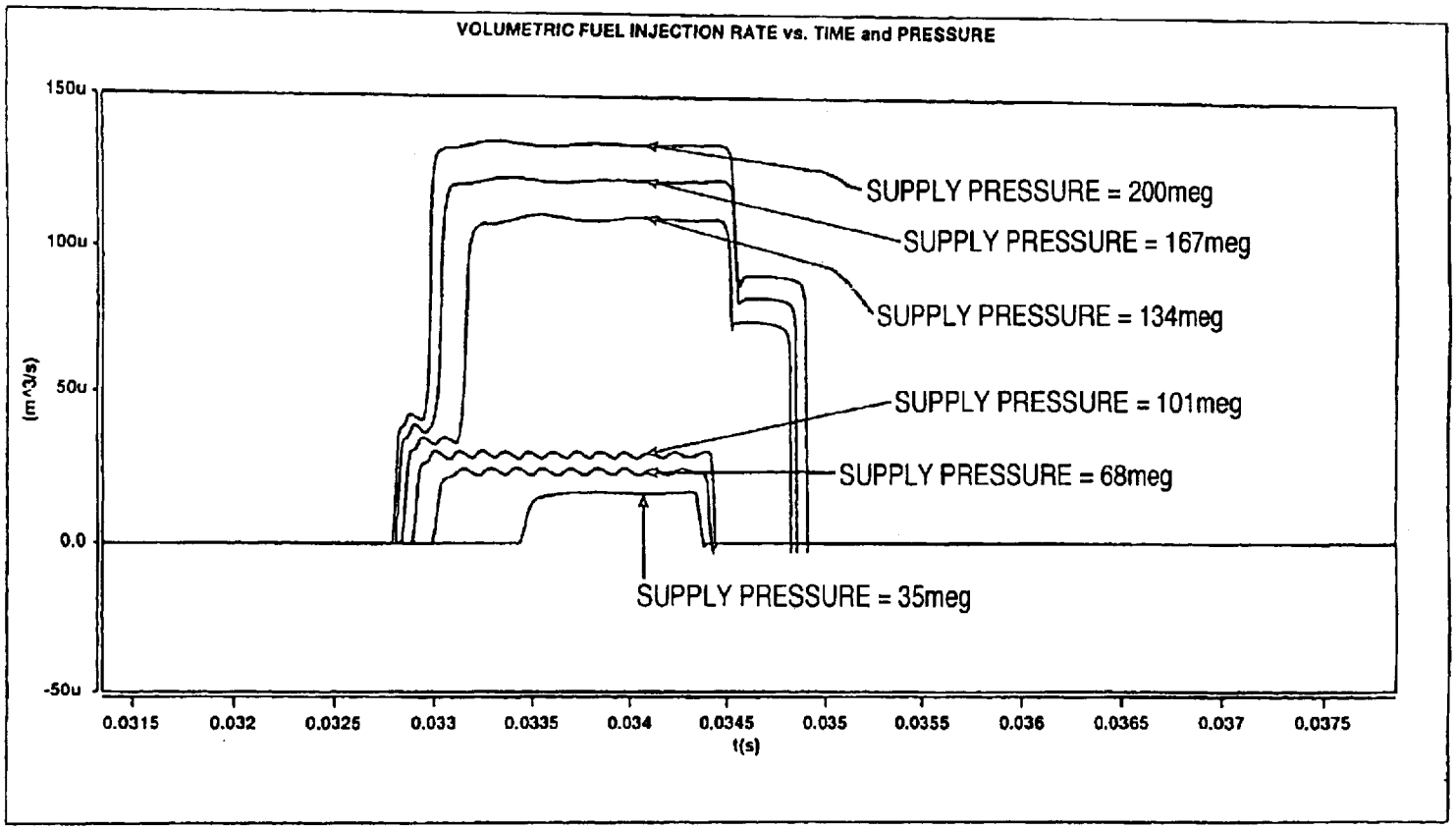
FIG. 6 is a graph showing instantaneous volumetric injection rate versus time for a given injection event at various supply pressures using the injector of the present invention.
Figure 7:
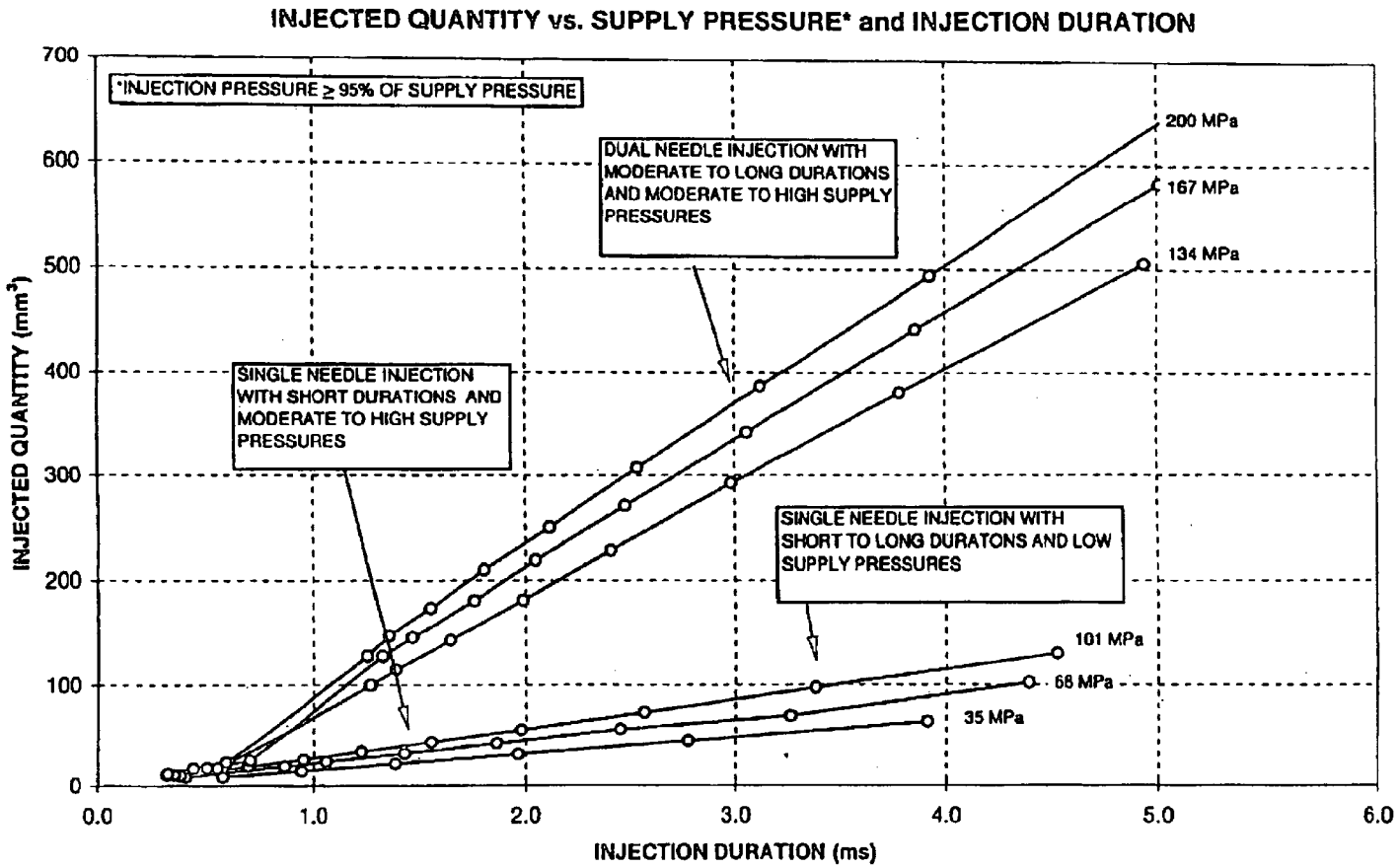
FIG. 7 is a graph showing injected quantity versus injection duration at various supply pressures for the injector of the present invention.

FIGS. 6 and 7 illustrate hydro-mechanical simulation results including plots of injected quantity versus supply pressure and actual injection duration. The supply pressure was varied from 35 to 200 MPa in six steps and the ratio of outer to inner spray hole areas was set to ½. Consequently, the ratio of single needle to dual needle injection rates was ⅓. The drain pressure was set to 0.1 MPa and the outer needle parameters were set to prevent operation when the supply pressure was less than approximately 110 MPa. In these cases, the rate shape is square with a sharp end of injection. Dual needle injection is evident in the rate shapes produced at the higher pressures of 134, 167 and 200 MPa. In these higher pressure cases, the rate shape includes a small leading boot of single needle injection and a trailing feature related to the early closing of inner needle valve element 42. The plots clearly show favorable low fueling controllability. FIG. 7 shows overlap in injected quantity between low pressure with long duration and high pressure with short duration.

Figure 9:
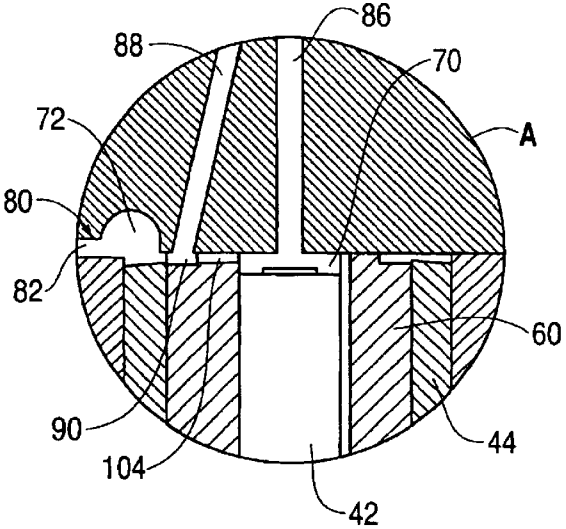
FIG. 9 is an expanded view of the area A of FIG. 8.
Figure 10:
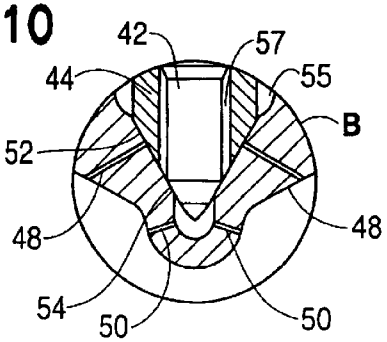
FIG. 10 is an expanded view of the area B of FIG. 8.
Figure 8:
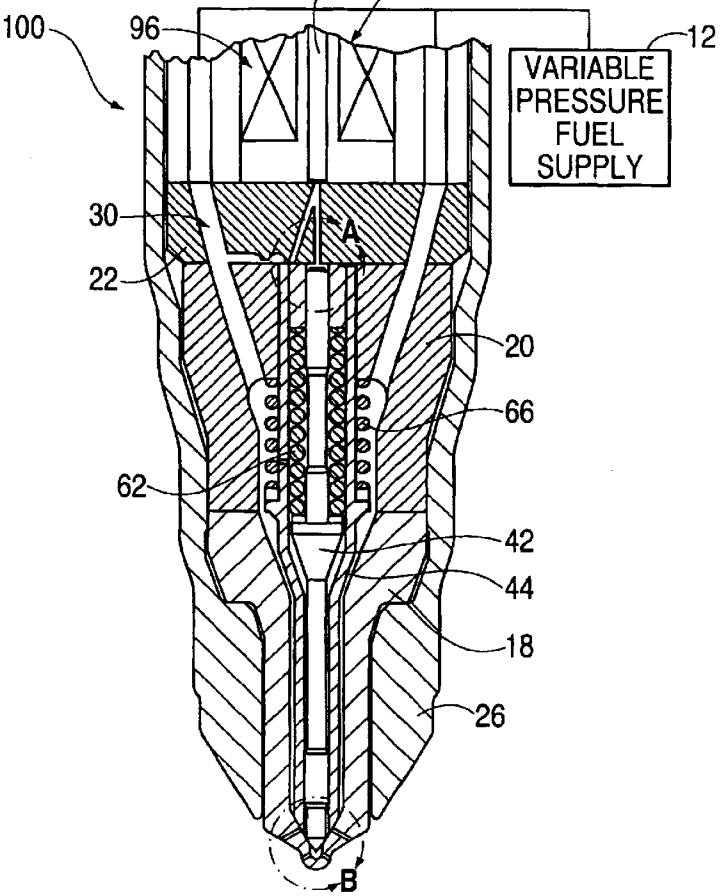
FIG. 8 is an enlarged cross sectional view of a second embodiment of the closed nozzle injector of the present invention.

FIGS. 8–10 illustrate a second embodiment of the present fuel injection system and fuel injector which is very similar to the system and injector of the first embodiment with the primary exceptions of a different charge circuit for supplying fuel to the control volumes and the preload setting of the biasing springs resulting in a different sequential order of operation of the needle valve elements. It should be noted that features of the present embodiment which are the same as the previous embodiment of FIG. 1 will be identified with like reference numerals. The variable pressure fuel injection system 100 of the present embodiment likewise includes variable pressure fuel supply 12 and a closed nozzle fuel injector 102 having many of the same features and components as closed nozzle injector 14 of the first embodiment. However, in the present embodiment, control volume charge circuit 74 includes a first charge passage 104 extending from annular groove 90 to inner control volume 70. Thus, inner control volume 70 is supplied with pressurized supply fuel via outer control volume 72 and first and second charge passages 104 and 80, respectively. It should also be noted that outer control volume drain passage 88 and inner control volume drain passage 86 extend through spacer 22 without intersecting but opening at the upper end of spacer 22 in close proximity so that control valve member 94 can effectively seal a valve seat surrounding the openings when control valve member 94 is in a closed position against the valve seat formed on spacer 22.

More importantly, the biasing spring preloads are set such that a lower fuel pressure affects the opening of outer needle valve element 44 while the preload of inner needle valve element 42 is set to require a higher minimum opening pressure. It should be noted that although the biasing spring preloads primarily determine the fuel pressure at which the valve elements 42, 44 open and close, the needle area ratios and control orifice flow coefficients also affect the opening pressure threshold and response characteristics for each valve element.

Referring to FIG. 10, it should also be noted that the present embodiment does not include a feed passage extending through the lower end of outer needle valve element 44 to supply fuel to inner supply cavity 57, since outer needle valve element 44 is the first valve to open and, once opened, inner supply cavity 57 will be exposed to supply fuel prior to the opening of inner needle valve element 42. It should be noted also that the diameter of inner needle valve element 42 at lower guiding surface 56 may be sufficiently less than the corresponding inner diameter of outer needle valve element 44 to permit fuel flow from inner cavity 46 into inner supply cavity 57.

Figure 11:
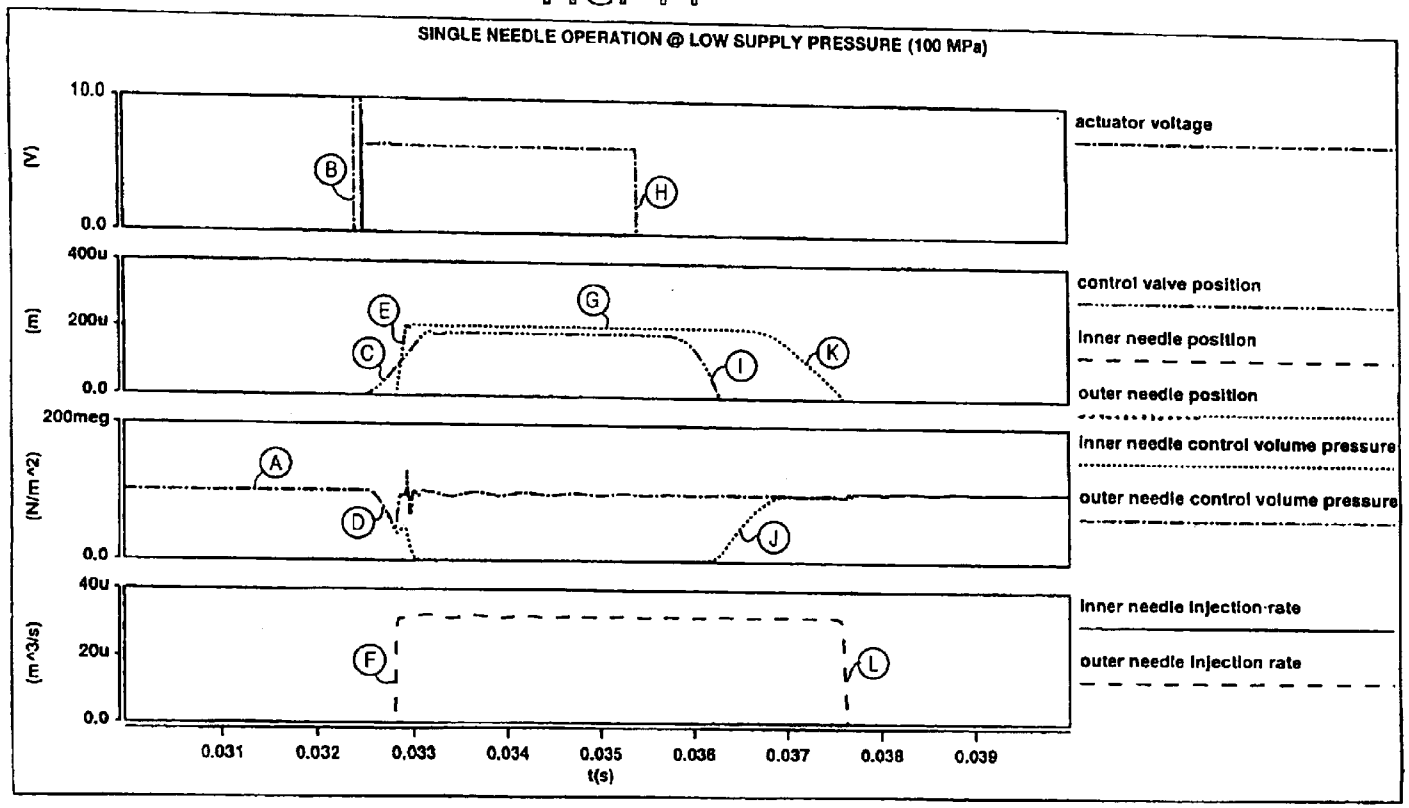
FIG. 11 is a graph showing actuator control voltage, control valve position, inner and outer needle position, inner control volume pressure, outer control volume pressure, inner needle injection rate and outer needle injection rate versus time during an injection event in the single needle operation mode with the injector of FIG. 8.

In the present embodiment, during the low pressure, single needle fuel injection mode, the sequence of operation is similar to that of the previous embodiment except that the outer needle valve element 44 opens and closes without the opening and closing of the inner needle valve element 42. Specifically, initially with the operating state at A in FIG. 11, the actuator assembly 96 is energized to open injection control valve 92 causing the fuel pressure in inner and outer control volumes 70 and 72, respectively, to decrease as fuel flows through inner drain passage 86 and outer drain passage 88. Repressurization of the control volumes is prevented by a restrictive outer inlet control orifice 82 positioned in second charge passage 80. The net hydraulic force that previously held outer needle valve element 44 against its valve seat quickly changes direction to oppose the preload of outer biasing spring 66 thereby permitting outer needle valve element 44 to lift (E) permitting fuel to pass from outer supply cavity 55 to the combustion chamber via the outer set of injection orifices 48 (F). Inner needle valve element 42 is maintained in a closed position and prevented from opening due to a higher minimum set opening pressure determined by the preload of inner biasing spring 62, and the relative size of the control orifices permitting flow into the control volume and out of the control volumes. Outer needle valve element 44 hovers (G) in a state of equilibrium near its upper stop. This hovering effect is similar to that described hereinabove with respect to the first embodiment. The termination of fuel injection is initiated by de-energizing actuator assembly 96 (H) causing the closing of injection control valve 92 (I). Fuel flowing through second charge passage 80 and then through first charge passage 104 repressurizes outer and inner control volumes 72, 70 (J). Outer needle valve element 44 then closes (K) and a fuel injection event is terminated (L). Inner needle valve element 42 remains closed during single needle injections to provide a mechanical guide for outer needle valve element 44 thereby reducing variations in spray plume geometry and atomization. As with the previous embodiment, fuel flowing in the vicinity of inner valve seat 54 provides a cooling effect to reduce the tendency for coking and plugging during prolonged periods of single needle operation. Coking and plugging of the inner needle injection orifices 50 may be avoided altogether during extended single needle operation by flexibly and intermittently operating inner needle valve element 42 as described hereinbelow.

During the moderate to high pressure dual needle fuel injection mode, both inner needle valve element 42 and outer needle valve element 44 are activated to maximize spray hole utilization and fuel injection rate, and to minimize opportunities for unused spray holes to coke and plug. The injection sequence is initiated by opening injection control valve 92. The areas of the needle valve elements exposed to fuel pressure and the biasing spring preloads are selected so that outer needle valve element 44 lifts into the open position and hovers near its upper stop provided by spacer 22 before inner needle valve element 42 responds. Inner needle valve element 42 then lifts after a brief pressure dependent time delay. Specifically, the hovering outer needle creates an additional flow restrictive mechanism which acts in series with the first charge passage 104 to reduce the pressure in the inner control volume 70 to a level which forces the inner needle 42 to open. Inner needle valve element 42 stops against spacer 22 rather than hovering near spacer 22 as the outer needle valve element 44 does. The fuel injection sequence is terminated by closing injection control valve 92 to block the drain flow of control fuel through first and second drain passages 86, 88. The combination of a pressure excluded area on the top of inner needle valve element 42 and the restricting effect of first charge passage 104 (which functions as a control orifice), delays the closing of inner needle valve element 42 until outer needle valve element 44 closes far enough to significantly restrict fuel flow to inner valve seat 54. In this way, the low flow outer needle valve element 44 is the first to open and the first to close.

Figure 12:
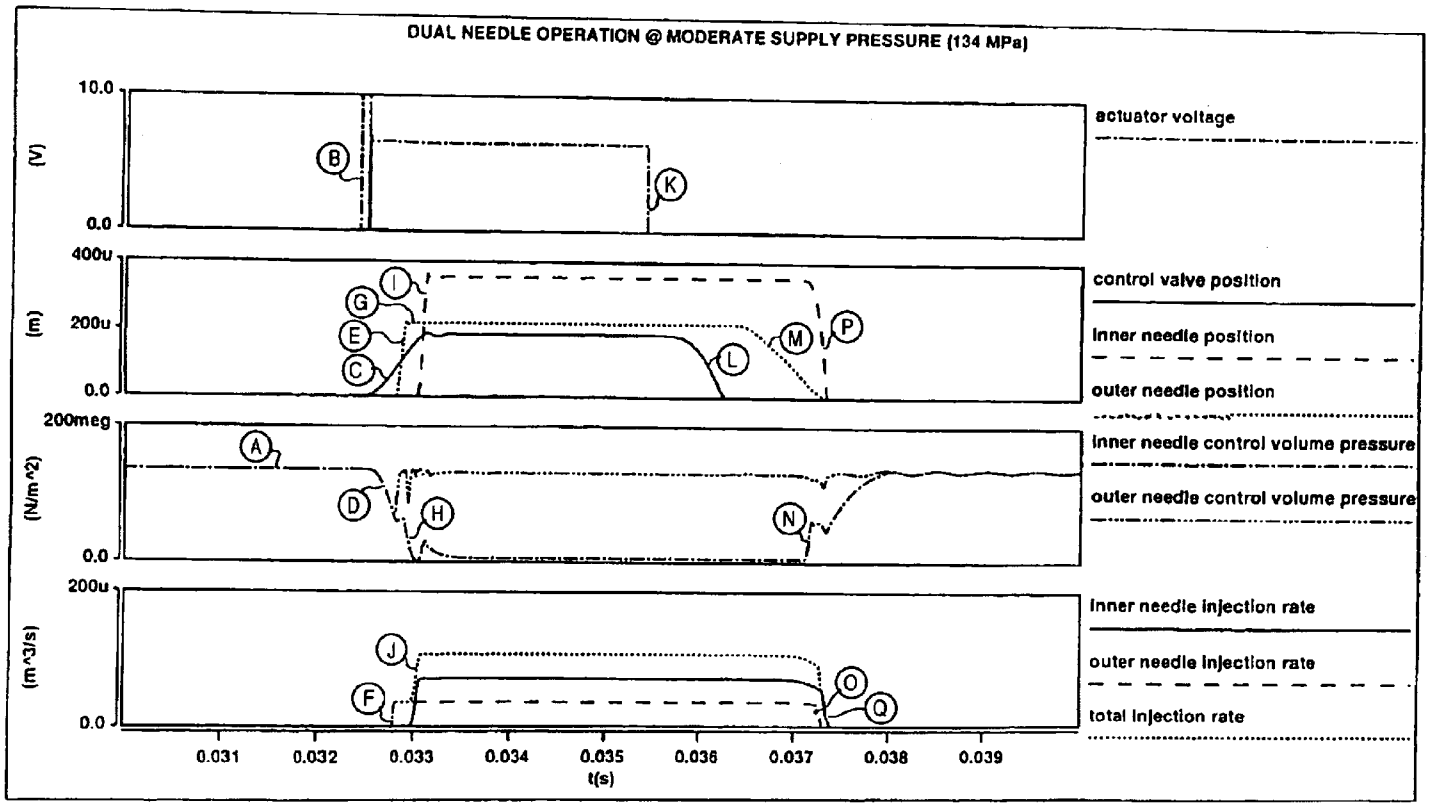
FIG. 12 is a graph showing actuator control voltage, control valve position, inner and outer needle position, inner control volume pressure, outer control volume pressure, inner needle injection rate, outer needle injection rate and total injection rate versus time during an injection event in the dual needle operation mode with the injector of FIG. 8.

FIG. 12 highlights the sequence of operations for dual needle fuel injection. The injector exists in a pressurized state (A), followed by the energization of actuator assembly 96 (B) which causes injection control valve 92 to open (C) resulting in a decrease in the fuel pressure in inner control volume 70 and outer control volume 72 (D). Outer needle valve element 44 then lifts (E) initiating a pilot injection (F) followed by outer needle valve element 44 hovering near its stop (G). Meanwhile, fuel pressure in inner control volume 70 continues to drop (H) causing inner needle valve element 42 to lift (I) thereby initiating the main injection (J). At a predetermined time, actuator assembly 96 is de-energized (K) causing the injection control valve 92 to close (L) and outer needle valve element 44 to move into the closed position (M). The first charge passage or control orifice 104 restricts the flow of control fuel into inner control volume 70 thereby delaying the repressurization of inner control volume 70 (N). Subsequently, however, eventually inner control volume 70 becomes repressurized sufficiently to cause the closing of inner needle valve element 42 (P) thereby ending the inner needle injection (Q).

The moderate to high pressure single needle operation mode, again, can be achieved at moderate to high supply pressures provided that the commanded injection duration is short enough to prevent the opening of inner needle valve element 42. Again, this operating mode may be desirable during transient engine conditions when it may not be possible, practical or efficient to rapidly change fuel supply pressure using variable pressure fuel supply 12.

Figure 13:
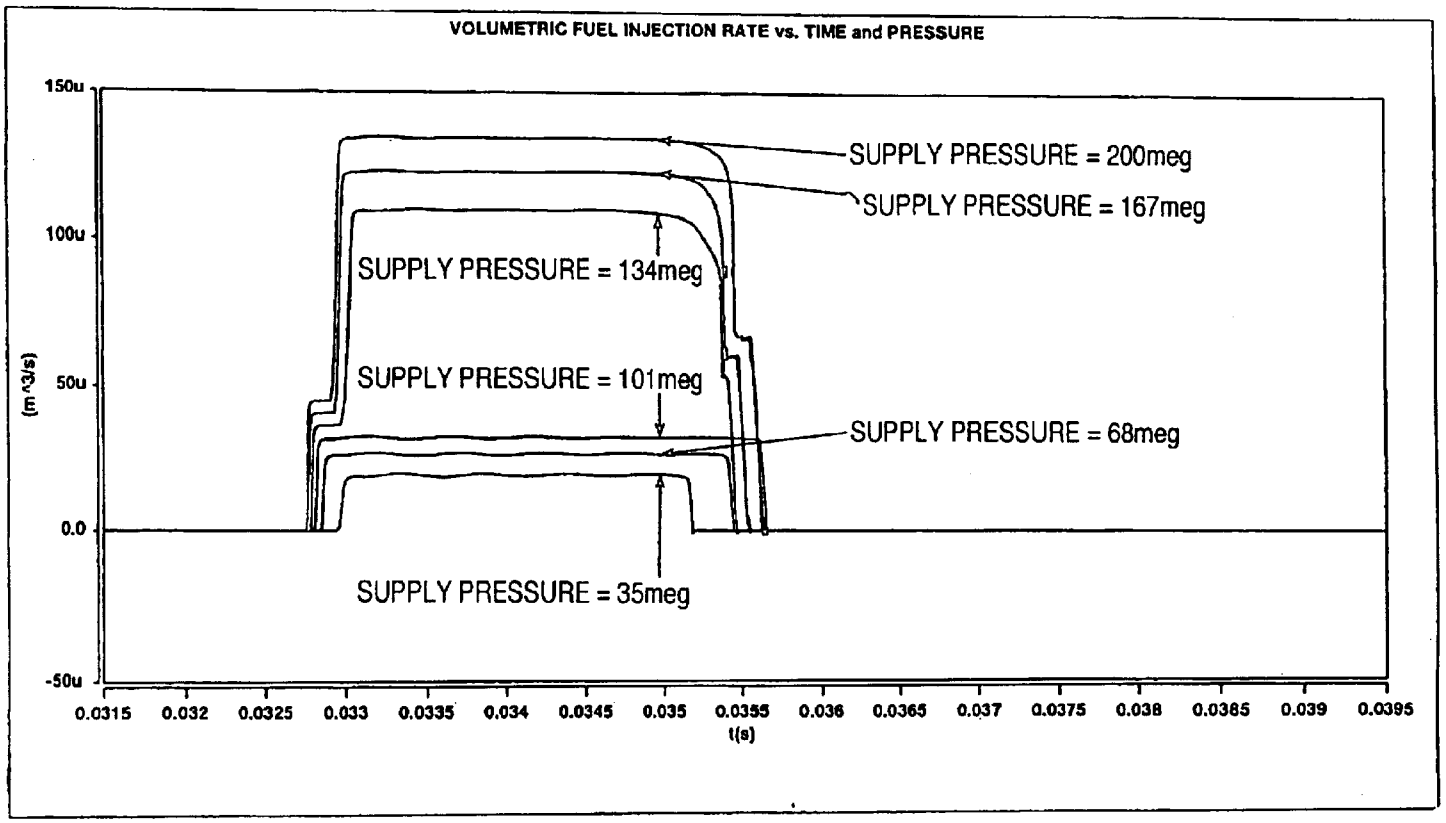
FIG. 13 is a graph showing instantaneous volumetric injection rate versus time for a given injection event at various supply pressures using the injector of FIG. 8.
Figure 14:
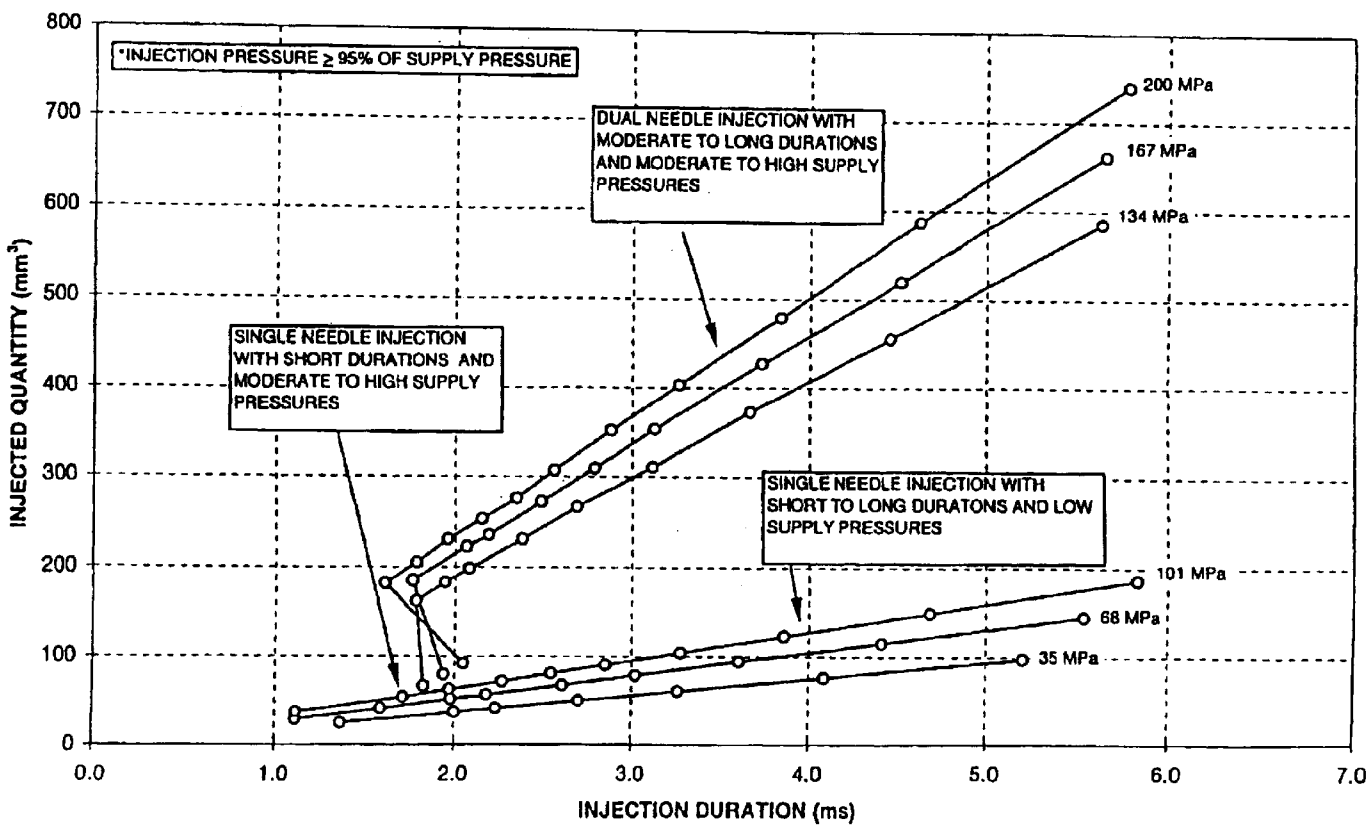
FIG. 14 is a graph showing injected quantity versus injection duration at various supply pressures for the injector of FIG. 8.

FIGS. 13 and 14 contain plots of injected quantity versus supply pressure and actual injection duration for various test cases similar to FIGS. 6 and 7 of the previous embodiment. FIG. 13 illustrates the well behaved, pressure controlled, dual injection rate capabilities of the nozzle assembly as well as clearly illustrating the various operating modes including a single needle injection with short to long injection durations and low supply pressures; single needle injection with short injection durations and moderate to high supply pressures; and dual needle injection with moderate to long injection durations and moderate to high supply pressures. Further, the plots suggest that a one firing cycle pressure response capability, as provided by U.S. Pat. No. 5,676,114, the entire contents of which is hereby incorporated by reference, would be beneficial to minimize injected quantity variations during transitions between single and dual needle operation. However, without such a pressure response capability, a conventional injected quantity estimation and control method could be used.

Figure 15:
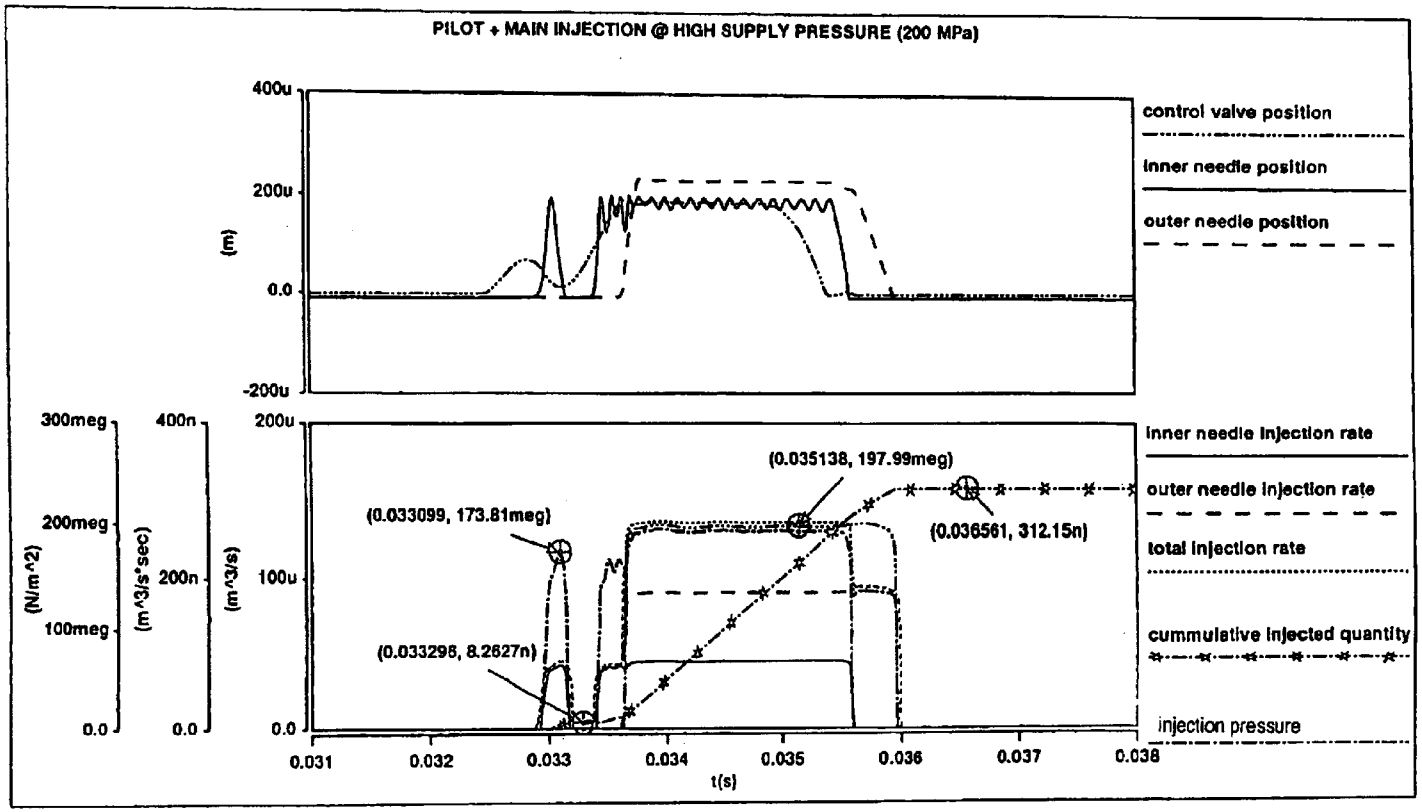
FIG. 15 is a graph showing the ability of the injector of the present invention to form a small detached pilot quantity followed by a main injection event by illustrating control valve, inner needle and outer needle positions, and inner needle, outer needle and total injection rates versus time.
Figure 16:
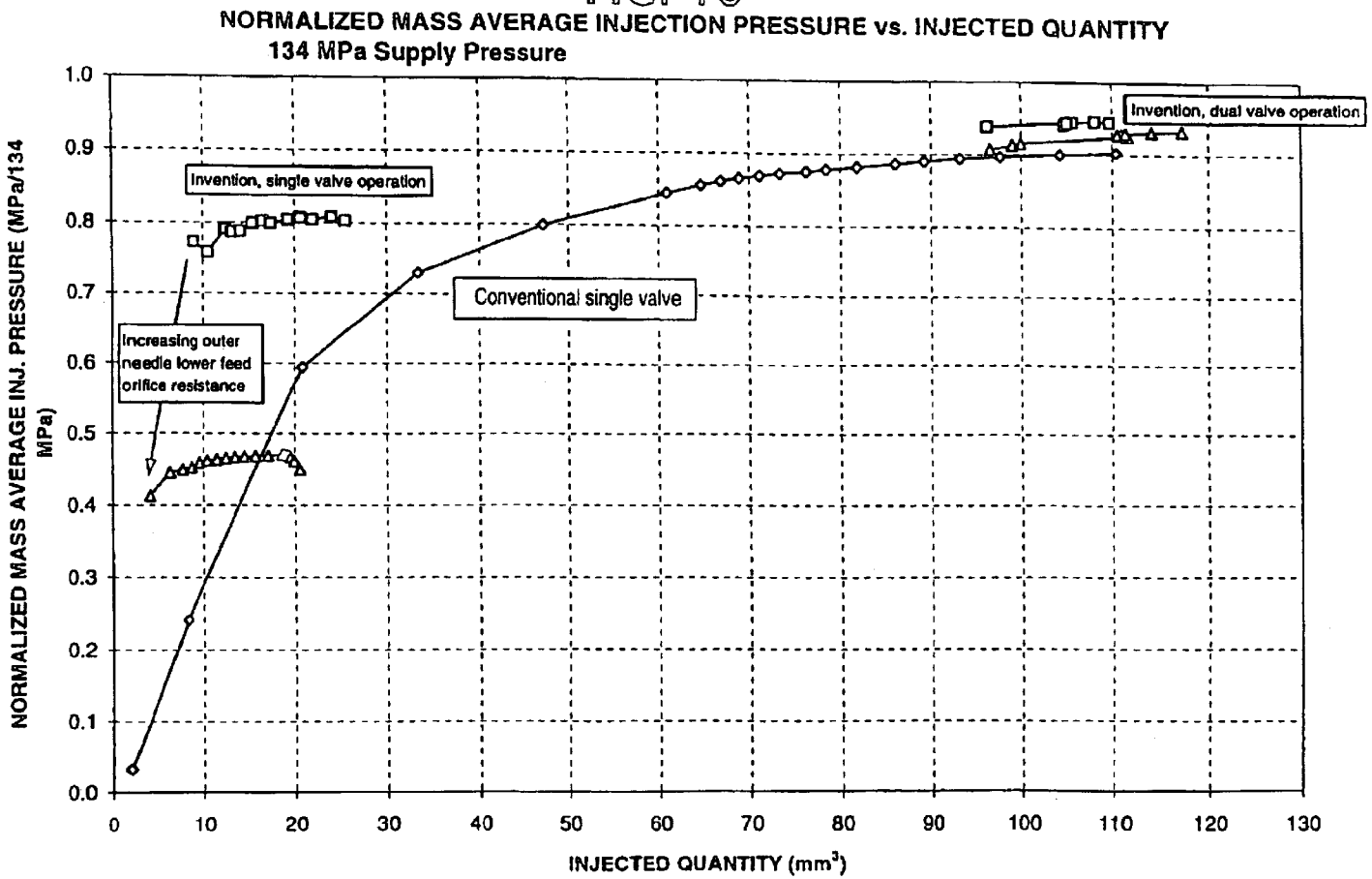
FIG. 16 is a graph showing normalized mass average injection pressure versus injection quantity using the system and injector of the second embodiment of the present invention as compared to a conventional single needle valve assembly.

FIG. 15 demonstrates the capability of the first embodiment of the present invention to produce a small quantity, i.e. 8 $mm^3$, high peak pressure, i.e. 174 MPa, a detached (200 $\mu$s separation) pilot quantity followed by a large primary injection quantity, i.e. 304 $mm^3$, soft start, high peak pressure, i.e. 198 MPa, main injection when the supply pressure is 200 MPa. FIG. 16 contains a comparison of normalized mass average injection pressure versus injected quantity obtained with the first embodiment of the present invention (FIG. 1) and a conventional single valve nozzle. The plots demonstrate the capability of the present invention to minimize internal pressure drop and thereby maximize mass average injection pressure as injected quantities approach zero. Pairs of plots corresponding to the present invention demonstrate the minimum injected quantity and mass average pressure reducing effects of increasing the flow resistance of the outer needle lower feed orifice.

INDUSTRIAL APPLICABILITY

It is understood that the present invention is applicable to all internal combustion engines utilizing a fuel injection system and to all closed nozzle injectors and especially applicable to fuel injection systems supplied with high pressure fuel at a controlled variable pressure level. This invention is particularly applicable to diesel engines which require different fuel injection rates in order to minimize emissions. Such internal combustion engines including a fuel injector in accordance with the present invention can be widely used in all industrial fields and non-commercial applications, including trucks, passenger cars, industrial equipment, stationary power plant and others.

We claim:

1. A fuel injection system for injecting fuel into the combustion chamber of an engine, comprising:

a variable pressure fuel supply for supplying fuel at various pressure levels;

a fuel injector including, an injector body containing an injector cavity and a plurality of injector orifices communicating with one end of said injector cavity to discharge fuel into the combustion chamber, said plurality of injector orifices including a first set of orifices and a second set of orifices, said injector body including a fuel transfer circuit for transferring supply fuel to said plurality of injector orifices;

a first needle valve element positioned in said injector cavity for controlling fuel flow through said first set of injector orifices and a first valve seat formed on said injector body, said first needle valve element movable from a closed position against said first valve seat blocking flow through said first set of injector orifices to an open position permitting flow through said first set of injector orifices;

a second needle valve element positioned in said injector cavity for controlling fuel flow through said second set of injector orifices and a second valve seat formed on said injector body, said second valve element movable from a closed position against said second valve seat blocking flow through said second set of injector orifices to an open position permitting flow through said second set of injector orifices;

a first control volume positioned adjacent an upper end of said first needle valve element for receiving fuel;

a second control volume positioned adjacent an upper end of said second needle valve element for receiving fuel;

a drain circuit for draining fuel from said first and said second control volumes to a low pressure drain; and an injection control valve positioned along said drain circuit for controlling the flow of fuel from both said first and said second control volumes through said drain circuit to permit movement of said first and said second needle valve elements between said open and said closed positions.

2. The injector of claim 1, wherein said first needle valve element is telescopingly received within a cavity formed in said second needle valve element to form a sliding fit with an inner surface of said second needle valve element.

3. The injector of claim 1, further including a throttle passage formed in said second needle valve element to restrict fuel flow upstream of said first set of injector orifices during a fuel injection event.

4. The injector of claim 1, further including a first biasing spring for biasing said first needle valve element toward said closed position and a second biasing spring for biasing said second needle valve element toward said closed position, said first biasing spring positioned within said cavity of said second needle valve element.

5. The injector of claim 4, wherein said first and said second biasing springs are positioned in overlapping relationship.

6. The injector of claim 4, further including a separator positioned between said first and said second control volumes and biased into a position by said first biasing spring.

7. The injector of claim 6, further including a first control volume charge circuit including a charge groove formed in an inner surface of said separator.

8. The injector of claim 1, wherein said first needle valve element is adapted to move from said closed position to said open position when said variable pressure fuel supply supplies fuel at a predetermined first pressure level while said second remains in a closed position, and wherein said second needle valve element is adapted to move into said open position when said variable pressure fuel supply supplies pressure at a second predetermined greater than said first pressure level.

9. A closed nozzle injector assembly for injecting fuel into the combustion chamber of an engine, comprising:

an injector body containing an injector cavity and a plurality of injector orifices communicating with one end of said injector cavity to discharge fuel into the combustion chamber, said plurality of injector orifices including an inner set of orifices and an outer set of orifices, said injector body including a fuel transfer circuit for transferring supply fuel to said plurality of injector orifices;

an inner needle valve element positioned in said injector cavity for controlling fuel flow through said first set of injector orifices and an inner valve seat formed on said injector body, said inner needle valve element movable from a closed position against said inner valve seat blocking flow through said inner set of injector orifices to an open position permitting flow through said inner set of injector orifices;

an outer needle valve element positioned in said injector cavity for controlling fuel flow through said outer set of injector orifices and an outer valve seat formed on said injector body, said outer valve element movable from a closed position against said outer valve seat blocking flow through said outer set of injector orifices to an open position permitting flow through said outer set of injector orifices;

an inner control volume positioned adjacent an upper end of said inner needle valve element for receiving fuel;

an outer control volume positioned adjacent an upper end of said outer needle valve element for receiving fuel;

a drain circuit for draining fuel from said inner and said outer control volumes to a low pressure drain;

an injection control valve positioned along said drain circuit for controlling the flow of fuel from both said inner and said outer control volumes through said drain circuit to permit movement of said inner and said outer needle valve elements between said open and said closed positions.

10. The injector of claim 9, wherein said inner needle valve element is telescopingly received within a cavity formed in said outer needle valve element to form a sliding fit with an inner surface of said outer needle valve element.

11. The injector of claim 10, further including a throttle passage formed in said outer needle valve element to restrict fuel flow upstream of said inner set of injector orifices during a fuel injection event.

12. The injector of claim 9, further including an inner biasing spring for biasing said inner needle valve element toward said closed position and an outer biasing spring for biasing said outer needle valve element toward said closed position, said inner biasing spring positioned within said cavity of said outer needle valve element.

13. The injector of claim 12, wherein said inner and said outer biasing springs are positioned in overlapping relationship.

14. The injector of claim 12, further including a separator positioned between said inner and said outer control volumes and biased into a position by said inner biasing spring.

15. The injector of claim 14, further including an inner control volume charge circuit including a charge groove formed in an inner surface of said separator.

16. The injector of claim 9, wherein said inner needle valve element is adapted to move from said closed position to said open position when said variable pressure fuel supply supplies fuel at a predetermined first pressure level while said outer remains in a closed position, and wherein said outer needle valve element is adapted to move into said open position when said variable pressure fuel supply supplies pressure at a second predetermined greater than said first pressure level.

* * * * *